US009903327B2

(12) United States Patent
Izzo et al.

(10) Patent No.: US 9,903,327 B2
(45) Date of Patent: Feb. 27, 2018

(54) FUEL INJECTOR

(71) Applicant: Continental Automotive GmbH, Hannover (DE)

(72) Inventors: Ivano Izzo, Pisa (IT); Marco Mechi, Vada (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 61 days.

(21) Appl. No.: 14/723,169

(22) Filed: May 27, 2015

(65) Prior Publication Data

US 2015/0354516 A1 Dec. 10, 2015

(30) Foreign Application Priority Data

May 27, 2014 (EP) ..... 14169986

(51) Int. Cl.
*F02M 59/00* (2006.01)
*F02M 51/06* (2006.01)
(Continued)

(52) U.S. Cl.
CPC ..... *F02M 51/0614* (2013.01); *F02M 41/00* (2013.01); *F02M 51/0664* (2013.01);
(Continued)

(58) Field of Classification Search
CPC ..... F02M 51/0614; F02M 51/0664; F02M 51/0685; F02M 51/0671; F02M 41/00;
(Continued)

(56) References Cited

U.S. PATENT DOCUMENTS 4,423,842 A * 1/1984 Palma ..... F02M 51/005 239/585.4
6,808,133 B1 * 10/2004 Stier ..... F02M 51/0614 239/585.1
(Continued)

FOREIGN PATENT DOCUMENTS

DE 63263 C 7/1892 ..... F16F 1/02
DE 1783503 U 2/1959 ..... F16F 1/06
(Continued)

OTHER PUBLICATIONS

"Machine Springed Overview," Helical Products Company, Inc., URL: http:/ /heli-cal.com/cm/Products/Machined-Springs/Home.html, 3 pages, Dec. 20, 2013.
(Continued)

*Primary Examiner* — Arthur O Hall
*Assistant Examiner* — Joel Zhou
(74) *Attorney, Agent, or Firm* — Slayden Grubert Beard PLLC

(57) ABSTRACT

A fuel injector includes a valve with a needle that is movable along a longitudinal axis between an open position and a closed position, for opening or closing the valve. The fuel injector also includes an actuator including an armature and a pole piece, the armature being axially movable and operable to interact mechanically with the needle, such that the needle is moved towards the open position by a movement of the armature in axial direction towards the pole piece. The fuel injector also includes a first spring for biasing the armature in axial direction away from the pole piece. The spring force of the first spring is configured to stop said movement of the armature when the needle is in the open position.

18 Claims, 9 Drawing Sheets

(51) Int. Cl.
*F02M 41/00* (2006.01)
*F02M 61/10* (2006.01)
*F02M 61/20* (2006.01)

(52) U.S. Cl.
CPC .... *F02M 51/0671* (2013.01); *F02M 51/0685* (2013.01); *F02M 61/10* (2013.01); *F02M 61/20* (2013.01); *F02M 2200/304* (2013.01); *F02M 2200/306* (2013.01)

(58) Field of Classification Search
CPC .. F02M 61/10; F02M 61/20; F02M 2200/306; F02M 2200/304
USPC ..... 239/533.2, 533.8, 533.9, 533.3, 533.7, 239/585.1–585.2, 88–93, 533.4, 96, 584, 239/124, 125, 102.1, 102.02, 5, 408, 410, 239/413, 414
See application file for complete search history.

(56) References Cited

U.S. PATENT DOCUMENTS

2002/0053282 A1* 5/2002 Duquette ..... F02M 59/102 92/12.2
2006/0255185 A1* 11/2006 Cristiani ..... F02M 51/0671 239/533.7
2010/0264229 A1* 10/2010 Facchin ..... F02M 51/0671 239/1
2011/0278368 A1* 11/2011 Hornby ..... F02M 51/0671 239/5

FOREIGN PATENT DOCUMENTS

| | | | | |
|---|---|---|---|---|
| DE | 4033945 | A1 | 5/1992 | ..... B21D 53/00 |
| EP | 2634413 | A1 | 9/2013 | ..... F02M 51/06 |
| EP | 2857670 | A1 | 4/2015 | ..... F02M 61/08 |
| GB | 880369 | A | 10/1961 | ..... F02M 51/06 |
| JP | 02241970 | A | 9/1990 | ..... F02M 51/06 |
| JP | 2013100756 | A | 5/2013 | ..... F02M 51/06 |
| WO | 2014/195064 | A1 | 12/2014 | ..... F02M 61/16 |

OTHER PUBLICATIONS

European Search Report, Application No. 14169986.8, 4 pages, dated Aug. 25, 2014.

* cited by examiner

FUEL INJECTOR

CROSS-REFERENCE TO RELATED APPLICATIONS

This application claims priority to EP Application No. 14169986 filed May 27, 2014, the contents of which are hereby incorporated by reference in their entirety.

TECHNICAL FIELD

The present invention concerns a fuel injector. More specifically, it concerns a fuel injector for use with a combustion engine in a motor vehicle.

BACKGROUND

A fuel injector for injecting fuel into a combustion engine comprises a valve that can be opened by means of an electrically driven actuator against the force of a spring. Different designs are known in the art, comprising electromagnetic or piezo actuators, digital or servo models and actuators for different fuel types such as gasoline or diesel.

US 2006/0255185 A1 shows a fuel injector with electromagnetic actuator in which the valve comprises a needle and the valve opens when the needle is moved in a direction of a nozzle of the injector.

An amount of fuel running through the injector is generally dependent on the time the actuator is driven. A flow curve that shows a relationship between the drive time and the throughput has generally three successive areas. Very short drive times relate to a ballistic area where the needle is never fully open and the injection is never fully stabilized. Nevertheless, flow rates are generally repeatable. With longer drive times, the injector will be in a non-linear area. In this area, the needle reaches full opening but the flow dynamics are not stabilized as not all parts of the injector had enough time to settle. With even longer drive times, a linear area is entered, where the needle reaches its fully open position, the flow is stabilized and all the moving parts of the injector have settled.

The smaller the non-linear area is, the smaller are part-to-part and shot-to-shot deviations. An ideal flow curve would be monotonic with only a ballistic area and a linear area.

In order to help the needle to mechanically settle during an opening phase, a hydraulic dampening area may be foreseen that provides hydraulic dampening. However, extensive dampening leads to slower opening transients and much slower closing transients, which is undesirable.

SUMMARY

One embodiment provides a fuel injector for injecting fuel into a combustion engine, the injector comprising: a valve with a needle that is movable along a longitudinal axis between an open position and a closed position, for opening or closing the valve; an actuator which comprises an armature and a pole piece, the armature is axially movable and operable to interact mechanically with the needle, so that the needle is moved towards the open position by a movement of the armature in axial direction towards the pole piece; and a first spring for biasing the armature in axial direction away from the pole piece, wherein the first spring is configured and operable to stop said movement of the armature by means of its spring force when the needle is in the open position.

In a further embodiment, the armature is spaced apart from the pole piece when the needle is in the open position.

In a further embodiment, the first spring is axially movable relative to the pole piece and has an axial play towards the pole piece when the needle is in the closed position.

In a further embodiment, a deflection of the first spring when the needle is in the open position is small compared to the play.

In a further embodiment, the armature is axially displaceable relative to the needle, the needle has an upper retainer and the armature is operable to establish a form-fit engagement with the upper retainer for moving the needle towards the open position, the injector further comprises a second spring for biasing the armature away from the upper retainer, the second spring being softer than the first spring.

In a further embodiment, the first spring is axially displaceable relative to the needle and axially arranged between the second spring and the armature so that a spring force of the second spring is transferred to the armature via the first spring.

In a further embodiment, the armature is spaced apart from the pole piece by a fuel filled axial gap, such that the gap is reduced when the needle is moved towards the open position, the gap being shaped and dimensioned such as to provide hydraulic dampening to the movement of the armature.

In a further embodiment, the first spring comprises a hollow cylindrical body with a radial opening.

In a further embodiment, the radial opening is a helical cut.

In a further embodiment, the injector further comprises a third spring for moving the needle towards the closed position.

In a further embodiment, a spring seat for an end of the third spring that is remote from the needle is axially movable relative to a spring seat for an end of the first spring that is remote from the armature for calibrating a preload of the third spring.

In a further embodiment, the spring seat for said end of the first spring is press-fitted into an opening of the pole piece and the spring seat for said end of the third spring is press fitted into an opening of the spring seat for said end of the first spring.

In a further embodiment, the third spring is harder than the second spring but softer than the first spring.

In a further embodiment, the needle is configured to open the valve when the needle is moved away from a nozzle end of the injector.

BRIEF DESCRIPTION OF THE DRAWINGS

Example embodiments are discussed below in detail with reference to the drawings, in which.

DETAILED DESCRIPTION

Figure 1:
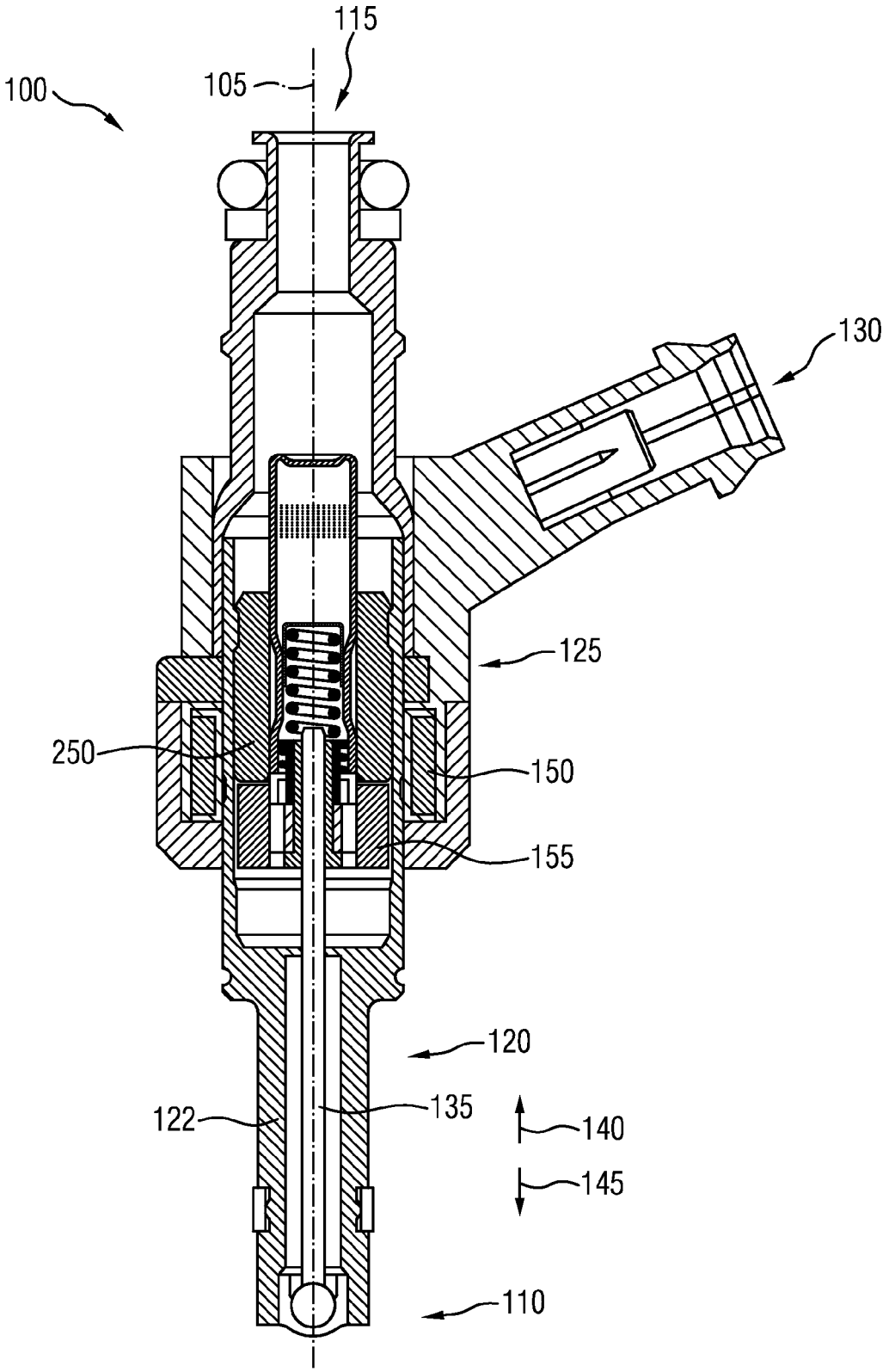
FIG. 1 shows a longitudinal section of an injector according to a first exemplary embodiment.

Embodiments of present invention provide an injector with improved opening and closing behaviour.

Some embodiments provide a fuel injector for injecting fuel into a combustion engine is disclosed. The fuel injector comprises a valve with a needle that is moveable between an open and a closed position, for opening or closing the valve. In particular, the needle is moveable between the open and the closed position along a longitudinal axis. The longitudinal axis is in particular also a longitudinal axis of a valve body of the fuel injector, the valve body in particular having a cavity in which the needle is received in reciprocatingly displaceable fashion.

Expediently, the needle is operable to interact with a valve seat to close the valve when it is in the closed position and axially displaceable away from the closed to the open position to open the valve, in particular to enable fluid flow from the cavity through an injection opening of the injector. The needle may be configured to open the valve when the needle is moved away from a nozzle end of the injector, i.e. in particular a direction from the injection opening towards a fluid inlet end of the valve body.

Further, the injector comprises an actuator. The actuator, which is in particular an electromagnetic actuator, comprises an armature and a pole piece. The armature is axially movable, in particular relative to the valve body. It is operable to interact mechanically with the needle so that the needle is moved towards the open position by a movement of the armature in axial direction towards the pole piece. The movement of the armature towards the pole piece is in particular effected by a magnetic force on the armature which is generated by the actuator, e.g., by means of a solenoid which is comprised by the actuator.

In addition, the injector comprises a first spring for biasing the armature away from the pole piece, in particular in axial direction. The first spring is configured and operable to stop the movement of the armature towards the pole piece when the needle is in the open position. In particular, the armature is operable to compress the first spring when it moves towards the pole piece to generate a spring force which compensates the magnetic force. In other words, the spring rate of the first spring, i.e. the stiffness of the first spring, is in particular configured such that the movement of the armature is stopped by the spring force of the first spring when the needle is in the open position.

In one embodiment, the armature is spaced apart from the pole piece when the needle is in the open position. In particular, the needle is not in form-fit engagement with an element other than the first spring in this situation. In other words, absent the first spring, the armature would be further displaceable axially towards the pole piece when the needle is in the open position.

Thus, when the needle reaches the open position, the armature will not be stopped by a stationary barrier, sometimes also called a "hard stop" by the person skilled in the art, but rather be cushioned by the elastic force of the first spring. Movement of the armature and the needle on the way from the closed to the open position and towards the pole piece may be slowed down rather gently by the first spring so that a fast and repeatable settling of the needle's quick opening movement may be achieved. This can help to reduce the above mentioned non-linear area so that better control over the amount of fuel injected into the combustion engine can be achieved over a broader range of injection times.

In one embodiment, an end of the first spring which is remote from the armature is positionally fix relative to the pole piece. Alternatively, the end of the first spring which is remote from the armature can be axially displaceable relative to the pole piece so that in one embodiment, the first spring is axially moveable relative to the pole piece. In an expedient development, the first spring has an axial play towards the pole piece when the needle is in the closed position. The needle may therefore be quickly accelerated by the armature before the compression of the first spring sets in and decelerates the armature. Faster opening of the valve may thus be accomplished.

The first spring may have very steep spring characteristics. With the high stiffness of the first spring, the force required to compress it over a predetermined length is preferred to be very high and may lie one or several magnitudes over the stiffnesses of other springs in the injector. Thus, according to another embodiment, a deflection of the first spring when the needle is in the open position is small compared to said play. Through this, acceleration and deceleration of the needle may be further improved. Control over the needle and therefore the valve may therefore be augmented.

In one embodiment the armature is axially displaceable relative to the valve needle. In order to enable the mechanical interaction between the armature and the needle, the needle has an upper retainer. The armature is in particular operable to establish a form-fit engagement with the upper retainer for moving the needle towards the open position.

In one development, the injector further comprises a second spring for biasing the armature away from the upper retainer. The second spring may also be denoted as armature return spring. By means of the bias of the second spring, surfaces of the armature and the upper retainer which abut one another for establishing the form-fit engagement may be axially spaced apart when the actuator is deenergized. In this way, a so-called free lift or blind lift of the armature is enabled. This allows opening of the needle against particularly high fluid pressures due to a large initial impulse transfer on the needle when the—already accelerated—armature hits the upper retainer. Expediently, the second spring is softer than the first spring. For example, its spring rate is smaller 50% or smaller, in particular 20% or smaller, for example 10% or smaller than the spring rate of the first spring.

In one embodiment, the first spring is axially displaceable relative to the needle. In one development, the first spring is axially arranged between the second spring and the armature so that a spring force of the second spring is transferred to the armature via the first spring. With advantage, the second spring also is operable to bias the first spring away from the pole piece. In this way, the position of the first spring is stabilized so that the axial play of the first spring may be particularly well defined. With the combination of the first, hard spring and the second, soft spring, high acceleration and quick deceleration of the needle may be achieved. The non-linear area of the injector's flow curve may thus be further reduced.

According to another embodiment, the armature is spaced apart from the pole piece by a gap, such that the gap is reduced when the needle is moved towards the open position. The gap is filled with fuel. In particular it is positioned within the cavity of the valve body. The gap is shaped and dimensioned such as to provide hydraulic dampening to the movement of the armature.

Through this, hydraulic dampening may help to save time in the deceleration process. The dampening may also help to further reduce a settling time of the needle in the open position. Surfaces that define said gap may be chosen to be relatively large so that the dampening effect may be controlled to be rather substantial. Preferably, opposing surfaces of the armature and the pole piece which define the gap remain spaced apart from one another—in places, preferably over the bigger part of their overlapping area or, particularly preferably, completely—when the armature is stopped by the first spring. In this way, hydraulic sticking between these two surfaces is avoided or at least largely reduced when the actuator is de-energized for initiating the closing movement of the armature-needle assembly. In this way, a particularly fast closing transient of the needle is achievable.

In one embodiment, the first spring comprises a hollow cylindrical body, i.e. a cylinder shell, with a radial opening. In one embodiment, it has a plurality of radial openings, such as bores through the sidewall of the cylinder shell. In another embodiment, the opening may run in a helical or transverse direction. For example, the radial opening is a helical cut through the sidewall of the cylinder shell. A spring of this type may have extremely hard spring characteristics and thus be well suited for the first spring. Springs of such type are in principle known to the skilled person under the trade name HELI-CAL or from German patent 63263, German utility model 1783503 and German patent application DE 40 33 945 A1.

In another embodiment, there is provided a third spring for moving the needle towards the closed position. The third spring may also be denoted as calibration spring. Preferably, the third spring has no play towards the needle. In one embodiment, the third spring is harder than the second spring and softer than the first spring. For example, the spring rate of the third spring is at most 50% of the spring rate of the first spring and the spring rate of the second spring is at most 50% of the spring rate of the third spring.

In one embodiment, ends of the first and third springs that are remote from to the armature and the needle, respectively, abut parts of the injector that are axially movable with respect to each other. To put it in a different way, a spring seat for an end of the third spring that is remote from the needle is axially movable relative to a spring seat for an end of the first spring that is remote from the armature for calibrating a preload of the third spring. For example, the spring seat for said end of the first spring is press-fitted into an opening of the pole piece and the spring seat for said end of the third spring is press-fitted into an opening of the spring seat for said end of the first spring.

It is therefore possible to adjust the tension of the third spring when the needle is in the open position independently from a position of the first spring. By adjusting said tension, a dynamic flow rate of fuel through the injector may be calibrated. Part-to-part variations between identically constructed injectors may thus be compensated during or after the manufacturing process.

FIG. 1 shows an injector 100 for injecting fuel into a combustion engine according to a first exemplary embodiment in a longitudinal section view.

The injector 100 has a longitudinal axis 105, a nozzle end 110 and an opposed supply end 115, sometimes also referred to as fuel inlet end and fuel outlet end, respectively. The injector 100 comprises a valve 120 and an actuator 125 for operating the valve 120. The actuator 125 is an electromagnetic actuator which is supplied with electrical power through a connector 130. When electrical energy is supplied to the connector 130, fuel flows from the supply end 115 through the valve 120 and is ejected from the injector 100 at the nozzle end 110.

In the shown embodiment, the valve 120 comprises a needle 135 that is movable along the axis 105 between an open position 140 in which the valve 120 is open and a closed position 145 in which no fuel can pass through the valve 120. The needle 135 is received in a cavity of a valve body 122 and axially displaceable relative to the valve body 122 in reciprocating fashion. The needle 230 is biased towards the closing position 145 by means of a calibration spring, also denoted as third spring 230 in the following.

The actuator 125 in the shown embodiment comprises a solenoid 150, a pole piece 250, and an armature 155. The pole piece 250 is positionally fix or in one piece with the valve body 122. The armature 155 is axially displaceable in reciprocating fashion relative to the pole piece 250. When the solenoid 150 is energized, it generates a magnetic field which is led along a magnetic path through the pole piece 250 and the armature 155 so that a magnetic force is exerted on armature 155 which attracts the armature 155 towards the pole piece 250 so that the armature 155 can be moved along the axis 105 towards the pole piece 250. When energizing stops, the force of the calibration spring may bias the armature 155 into the opposite direction, in particular by means of mechanical interaction via the needle 135. The armature 155 is mechanically coupled with the needle 135 so that the position of the needle 135 can be controlled electrically by the actuator 125 via the armature 155. It is preferred that the needle 135 is moved towards the open position 140 when the solenoid 150 is energized and towards the closed position 145 when no current flows through solenoid 150.

Figure 2:
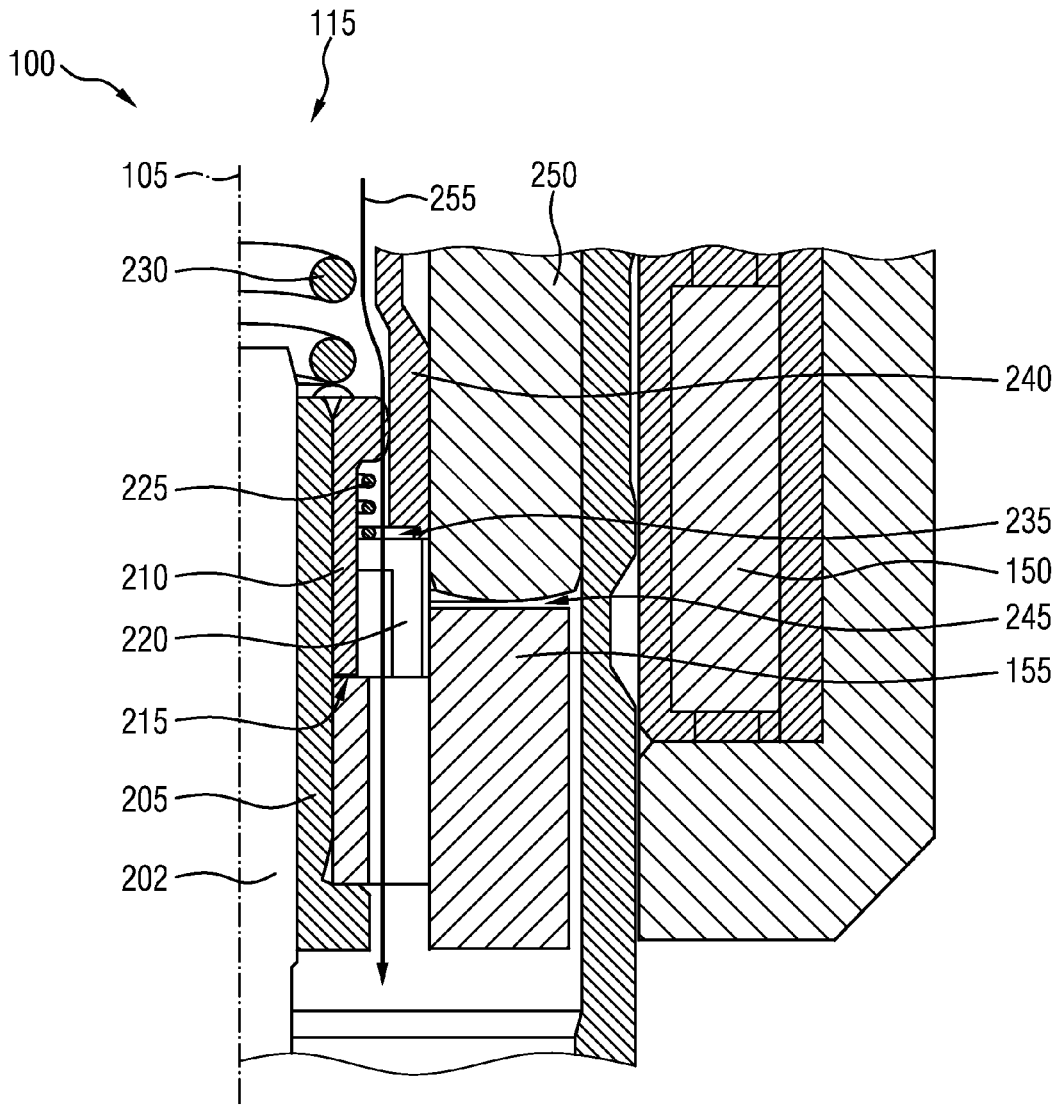
FIGS. 2 and 3 show enlarged details of the injector of FIG. 1.
Figure 3:
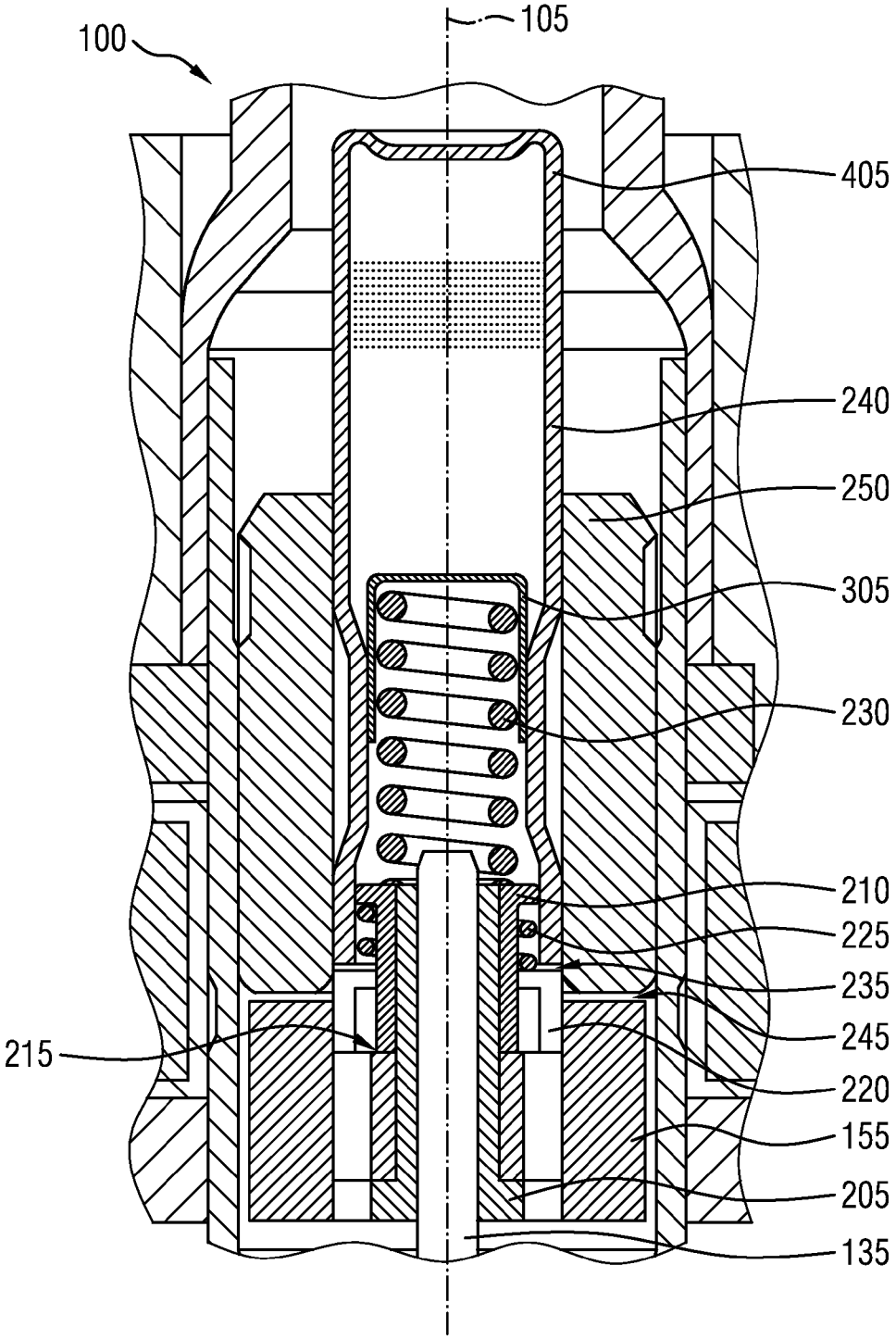

FIGS. 2 and 3 show enlarged details of the injector 100 of FIG. 1. The needle 135 is in the closed position 145 which relates to a lower position of armature 155 in the depicted embodiment.

The needle 135 comprises a bushing 205 and an upper retainer 210. The bushing 205 is affixed to a shaft 202 of the needle 135 and extends circumferentially around a portion of the shaft 202. The upper retainer 210 is affixed to the bushing 205 and extends laterally around a portion of the bushing 205. A section of the armature 155 lies between axial surfaces of the bushing 205 and the upper retainer 210, respectively.

In this, there is a predetermined play 215 of the armature 155 towards the needle 135. In other words, the armature 155 is axially displaceable relative to the needle 135. The axial displaceablility of the armature 155 relative to the needle 135 is limited by the upper retainer 210 in axial direction towards the pole piece 250 and is limited by the bushing 205 in axial direction away from the pole piece 250. The armature is thus operable to establish a form-fit engagement with the upper retainer 210 for taking the needle 135 with it away from the closing position 145 when it is moved towards the pole piece 250 by means of the magnetic force generated by the solenoid 150.

A first spring 220, which may be very stiff, rests axially on a surface of the armature 155 that faces towards the pole piece 250. The first spring 220 is axially displaceable in reciprocating fashion relative to the needle 135, relative to the pole piece 250, and in particular also relative to the armature 155. It is conceivable that the first spring is a coil spring. Preferably, however, the first spring 210 may be represented by a metal tube with one or more radial openings 505. For example, the metal tube has a cylinder-shell section comprising a helical cut through the circumferential sidewall of the cylinder-shell. Alternatively or additionally, the sidewall may have a plurality radial of bores which may be elongated in circumferential direction and which are preferably distributed in circumferential and axial direction.

A second spring 225 is disposed between axial surfaces of the first spring 220 and the upper retainer 210 so that it presses the first spring 220 towards the armature 155 and at the same time biases the armature 155 away from the upper retainer 210 and into contact with the bushing 205. The third spring 230, i.e. the calibration spring, presses down onto the assembly of needle shaft 202, bushing 205 and retainer 210 such as to provide a closing force on the needle 135. As will be shown later, an end of third spring 230 that is remote from said assembly is supported by a fixed part 240 that is attached to the valve body 122 or the pole piece 250. The third spring 230 is preferred to be harder than the second spring 225 but softer than the first spring 220.

The injector 100 is configured such that the first spring 220 is compressible between and by the fixed part 240 and the armature 155. When the valve needle 135 is in the closed position 145, an axial gap 235 is established between the fixed part 240 and the first spring 220.

When the actuator 125 is energized, the solenoid 150 generates a magnetic field that attracts the armature 155 so that it starts to move axially towards the pole piece 250. Due to the movement of the armature 155, the play 215 is reduced to zero and the armature 155 engages with the upper retainer 210. Further movement of the armature 155 in the same direction will move the needle 135 towards the open position 140.

Due to the further movement of the armature 155, the axial gap 235 between an axial end of the first spring 220 that is remote from the armature 155 and the fixed part 240 is reduced until the first spring 210 engages with the fixed part 240. In particular, the fixed part 240 represents a spring seat for the axial end of the first spring 220 that is remote from the armature 155 in this way.

Subsequently, the first spring 220 is compressed by further movement of the armature 155 towards the pole piece, the movement still being driven by the magnetic force caused by the solenoid 150. Through compression of the first spring 220, the net force on the armature 155 is reduced and the armature is decelerated until the movement of the armature 155 towards the pole piece 250 is stopped when the open position 140 of the needle 135 is reached. The needle 135 may overshoot this position by no more than the amount of play 215. In this case, the needle 135 will be pushed back by the third spring 230 into the open position 140.

In one embodiment, an axial surface of the armature 155 encloses an further axial gap 245 with the pole piece 250. When the armature 155 is moved from the closed position 145 to the open position 140, the size of the gap 245 is reduced. By this movement fuel 255 inside the cavity of the valve body 122 is squeezed out of the further axial gap 245 so that hydraulic dampening occurs to the movement of the armature 155. However, the further axial gap 245 is preferably non-zero when the armature 155 and needle 135 are at rest in the open position 140 of the needle 135.

The first spring 220 may help to reduce a slope of a flow curve in a linear area as discussed above. The hydraulic dampening around further axial gap 245 can be used to reduce the width of a non-linear area of the flow curve.

In one embodiment, the fixed part 240 comprises a fuel filter. The fixed part 240 is comprises a metal tube which is press-fitted into a central opening of the pole piece 250. the fixed part 240 may have an outer tube 405 comprising the fuel filter—for example embodied as bores in the outer tube—and an inner sleeve 305 comprising a spring seat for the end of the third spring 230 which is remote from the needle 135. The outer tube 405 protrudes axially beyond a downstream end of the inner sleeve 305 and radially encloses a portion of the third spring 230. A spring seat for the end of the first spring 220 which is remote from the armature 155 is preferably comprised by the outer tube 405. The upper end of the third spring 230 that is remote from the needle 135, rests against the sleeve 305 that is axially held by friction or otherwise fixed to the outer tube of the fixed part 240. In turn, the outer tube of fixed part 240 may be held by friction against the pole piece 250. The outer tube may have a constriction where it is radially spaced apart from the pole piece 250 and where the inner sleeve 305 is connected to the outer tube. In this way, easy assembly of the inner sleeve and the outer tube is achievable and a desired press-fitting force for the press-fit connection to the pole piece 250 is well adjustable.

During or after manufacturing, the injector 100 may be calibrated to a predetermined flow rate of fuel 255 between the supply end 115 and the nozzle end 110 when the needle 135 is in the open position 140. To this end, tension and/or position of the third spring 230 may be adjusted. In the shown embodiment, both tension of the third spring 230 when the needle 135 is in the open position and size of the axial gap 235 when the needle 135 is in the closed position 145 may be calibrated at the same time by axially moving the fixed part 240 with respect to pole piece 250.

Such a fixed part 240 may also be useful for other embodiments of injectors 100 according to this disclosure or for any other solenoid injector having a calibration spring.

Figure 4:
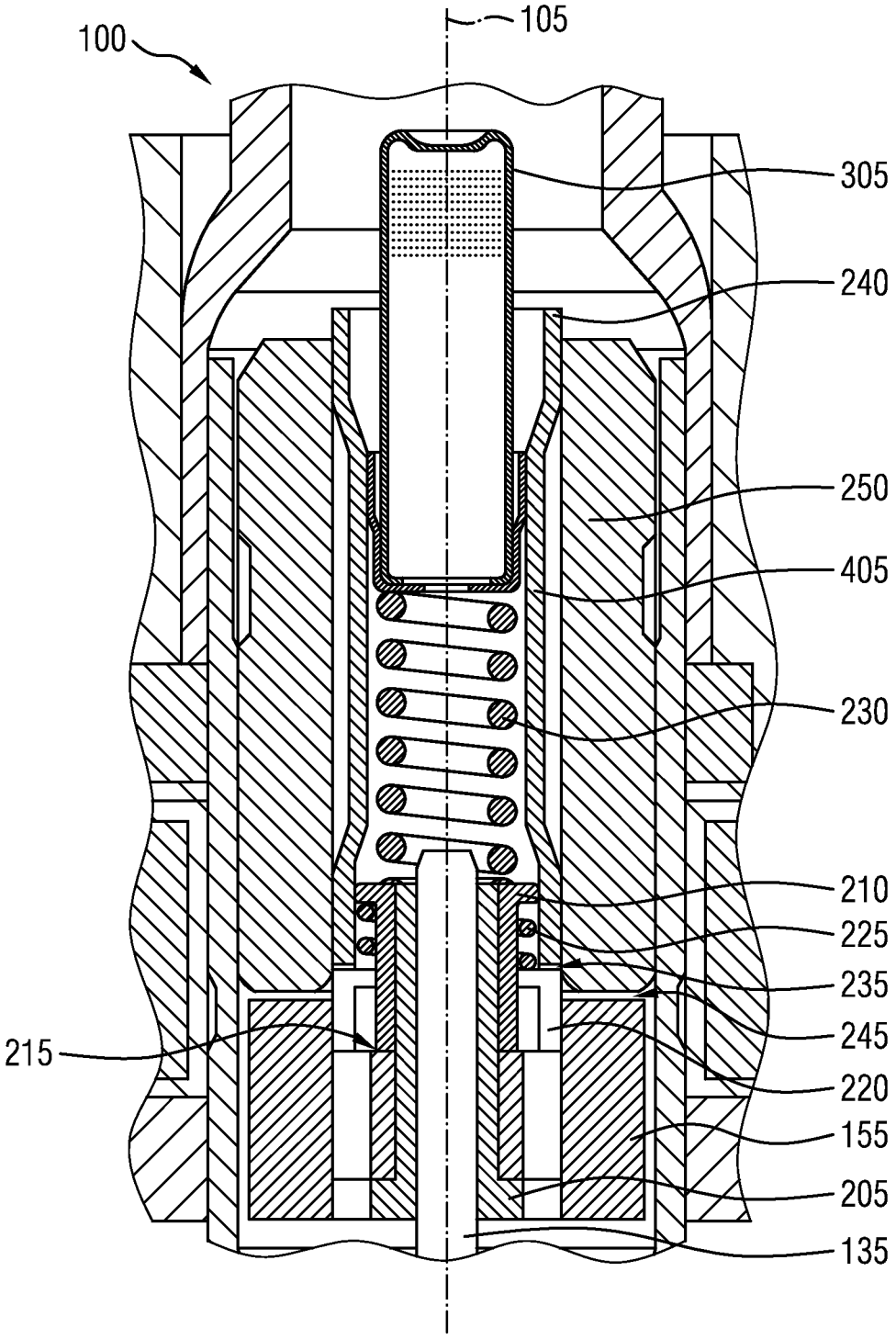
FIGS. 4-9 show longitudinal sections of injectors according further exemplary embodiments.

FIG. 4 shows a further exemplary embodiment of an injector 100. It is of the same basic construction as the injector according to the first embodiment, but differs from the embodiment of FIGS. 1-3 in the construction details of the fixed part 240.

In the present embodiment, the inner sleeve 305 comprises the fuel filter. The inner sleeve 305 is embodied, for example, according to one of the embodiments of a fluid filter which are disclosed in applicant's co-pending PCT-application PCT/EP2014/058700. The disclosure contents of this application relating to the construction of the fluid filter and in particular the embodiments of fluid filters disclosed in this application are herewith incorporated into the present description by reference for all purposes. In particular, the inner sleeve 305 may have a filter element and a fastening element which comprises a fitting portion for fastening the filter in the outer sleeve 405. By means of such an inner sleeve 305, a particularly reproducible press-fit connection to the outer tube 405 is achievable.

Further, in the present embodiment, the outer tube 405 is open at both axial ends and the inner sleeve 305 protrudes axially from an upstream end of the outer tube 405. The upstream end of the outer tube 405 is radially spaced apart from the inner sleeve 305.

The outer tube 405 may therefore be moved axially during a calibration process such as to determine the width of gap 235 when the needle 135 is in the closed position 145. Independently from this, an axial force onto the inner sleeve 305 may be applied to adjust the axial position of the sleeve 305 with respect to the outer tube 405. In this way, the spring seat for the end of the third spring 230 that is remote from the needle 135 is axially movable relative to the spring seat for the end of the first spring 220 which is remote from the armature 155 for calibrating a preload of the third spring 230. Through this, tension of the third spring 230 when the needle 135 is in the open position 140 may be calibrated independently from the size of the axial gap 235 between the outer tube 405 and the first spring 220.

Such a fixed part 240 may also be useful for other embodiments of injectors 100 according to this disclosure or for any other solenoid injector having a calibration spring.

Figure 5:
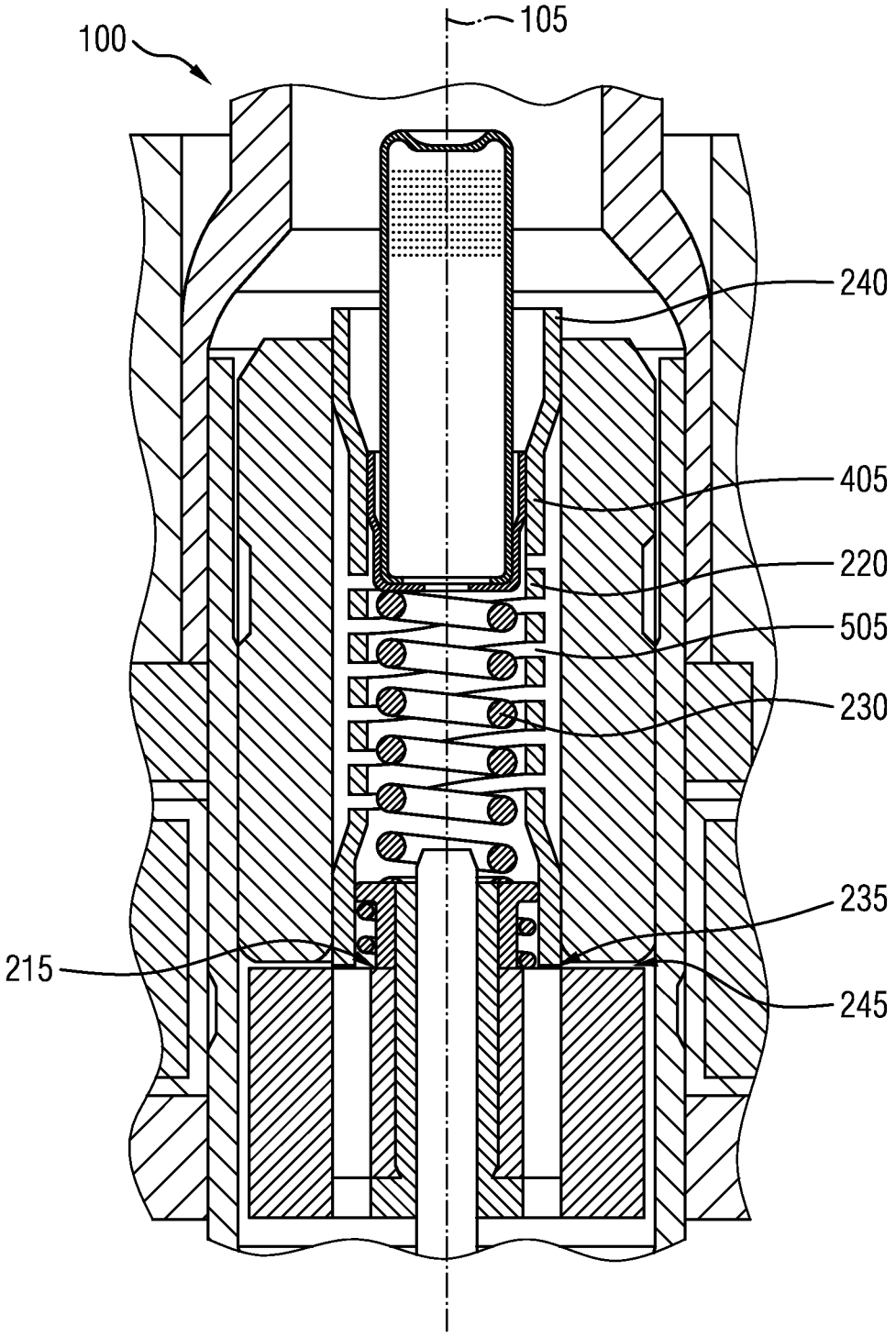

FIG. 5 shows another exemplary embodiment of an injector 100 which in general corresponds to the embodiment disclosed above in connection with FIG. 4. In contrast thereto, the first spring 220 is made from a section of the fixed part 240, specifically from a section of the outer tube 405. For this, the hollow cylinder body of the outer tube 405 may carry one or several radial openings 505. The openings are preferred to extend in a direction other than that of longitudinal axis 105. In the present embodiment, the radial opening 505 is in the shape of a helical cut through the hollow cylinder body, the helical cut and the hollow cylindrical body sharing the longitudinal axis 105 as central axis. As in the embodiment shown in FIG. 4, independent calibration of tension of the third spring 230 and the size of the gap 235 may be carried out.

The spring seat for the end of the first spring 220 which is remote from the armature 155 is represented by an upstream portion of the outer sleeve 405 in the present case. The first spring 220 is not axially moveable relative to the pole piece 250 during operation of the injector 100 but for calibration purposes via press-fitting the outer sleeve 405 into the opening of the pole piece 250. While in the previous embodiments, the downstream end portion of the outer sleeve 405 may or may not be in press-fit engagement with the pole piece 250, the downstream end portion of the outer sleeve 405 not in press-fit engagement with the pole piece 250 but is axially displaceable relative to the latter so that the section of the outer sleeve 405 which represents the first spring 220 can be compressed by the armature 155. The axial gap 235 is established between the downstream end portion of the outer sleeve 405 and the armature 155 in the present embodiment.

Figure 6:
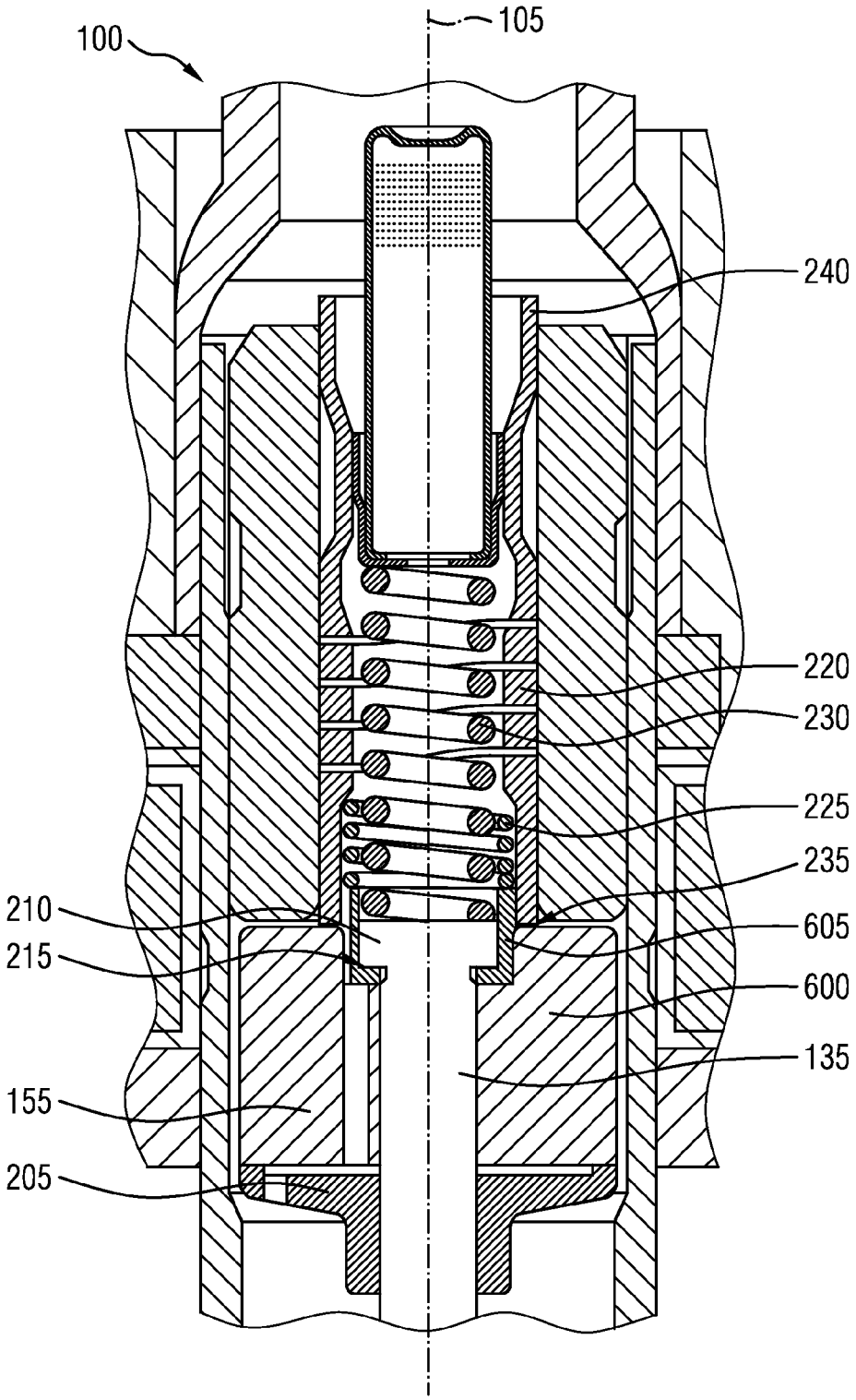

FIG. 6 shows yet another example embodiment of an injector 100 according to the invention. The first spring 220 is again realized as a section of the fixed part 240 and the third spring 230 presses directly onto the needle 135 as in the previous embodiments. The present embodiment differs from the embodiment discussed above with respect to FIG. 5 in that the upper retainer 210 is integrated in the shaft 202 of the valve needle 135, in that the armature 155 comprises a main body 600 and an insert 605, and in that the second spring 225 is connected in series to the first spring instead of being seated against the upper retainer 210.

More specifically, the upper retainer 210 is not a separate part in the present embodiment but it is represented by a radially protruding collar at the upstream end of the shaft 202 of the needle 135. In addition, the bushing 205 is embodied as a disc element downstream of the armature 155 in the present embodiment.

The insert 605 is fixed to the main body 600 of the armature 155, for example by press-fitting and/or welding. The upper retainer 210 and a portion of the shaft 202 are received in a central opening of the insert 605. The shaft 202 of the needle 135 protrudes axially from the insert 605, and also from the main body 600, of the armature 155 in direction away from the pole piece 250.

The insert 605 axially projects beyond the main body 600 in direction towards the pole piece 250. The insert 605 may provide radial support for the third spring 230, in particular by receiving an end of the third spring 230 in the central opening. Since the insert 605 embraces the upper retainer 210 and due to its dimensions, it functions as axial guide for the needle 135 via interaction with the retainer 210 and/or the shaft 202

An upper axial end of the insert 605 abuts the second spring 225, the other end of which rests against an end of the first spring 220 which faces towards the armature 155. In this way, the first spring 220 and the second spring 225 are connected in series in the present embodiment.

The calibration of gap and tension in the shown embodiment may be carried out like described above for instance with respect to the embodiment of FIG. 5.

Figure 7:
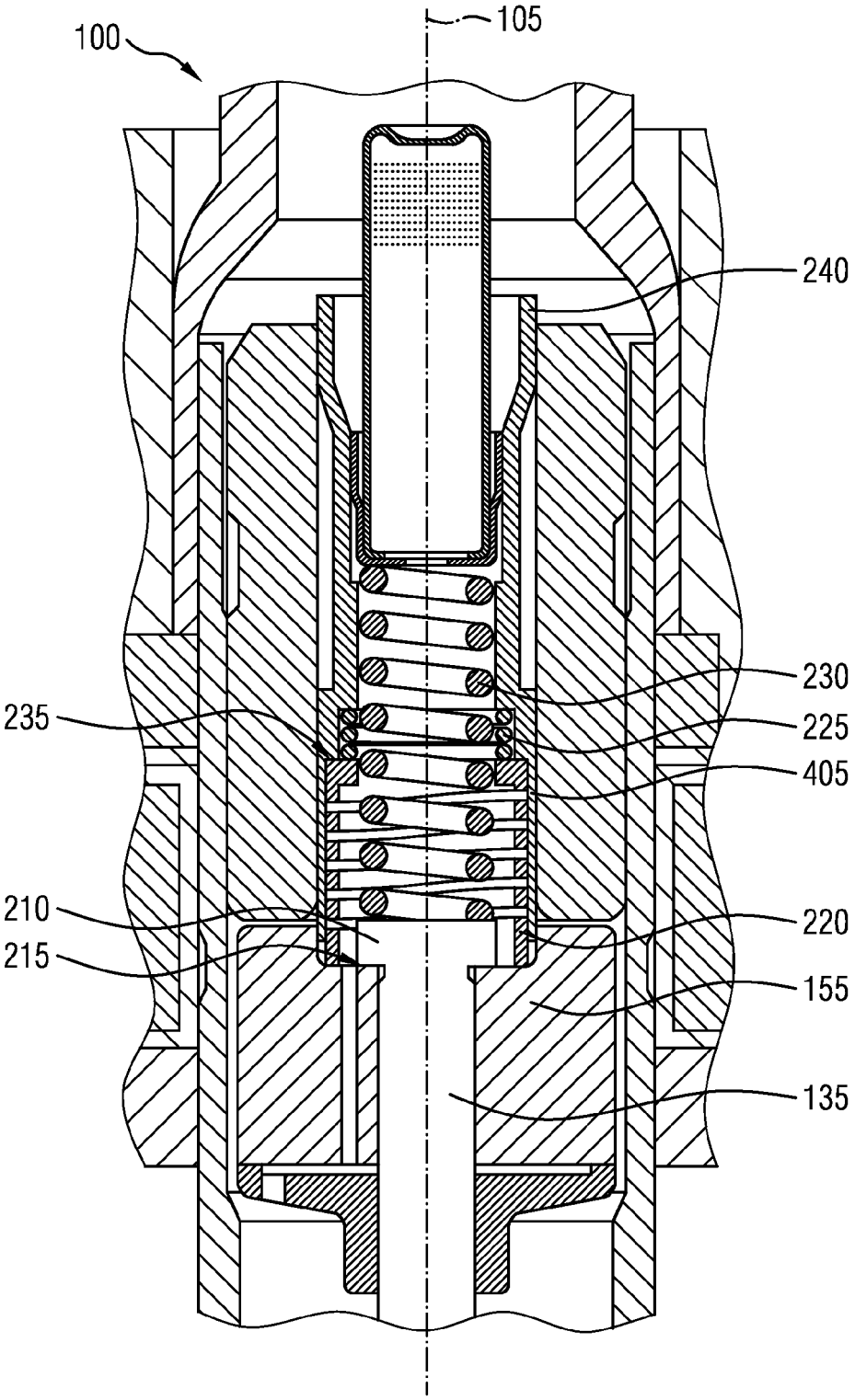

FIG. 7 shows yet another exemplary embodiment of an injector 100. The present embodiment is a variant of the embodiment described in connection with FIG. 4 above.

In the present embodiment, the upper retainer is embodied as a collar of the shaft 202 of the needle 135 and the bushing 205 is embodied as a disc element as described in connection with FIG. 6 above. The outer tube 405 of the fixed part 240 protrudes axially from the pole piece 250 and into a central opening of the armature 155 so that it overlaps axially with the armature 155, in particular to guide the axial movement of the latter.

Unlike the embodiment of FIG. 4, the first spring 220 is not arranged axially subsequent to the fixed part 240 so that a downstream axial end of the fixed part 240 represents the spring seat for the end of the first spring 220 which is remote from the armature 155. Rather, the first spring 220 is shifted partially into the outer tube 405 of the fixed part 240 so that only a portion of the first spring 220 projects from the outer tube 405, i.e. the fixed part 240. The outer tube 405 has a step representing the spring seat for the end of the first spring 220 which is remote from the armature 155. The axial gap 235 between the fixed part 240 and the first spring 220 which is reduced by the movement of the armature 155 towards the pole piece 250 before the first spring 220 is compressed by further movement of the armature 155 in the present embodiment established between said step of the tube 405 and the first spring 220.

Further unlike the embodiment of FIG. 4, the second spring 220 is not seated against the needle 135 but against the fixed part 240, specifically against a further step of the outer tube 405 upstream of the above mentioned step. The second spring 225 is clamped between the further step and the end of the first spring 220 which is remote from the armature 155. In this way, the second spring 225 is operable to bias the first spring 220 away from the step and to bias the armature 155 away from the upper retainer 210 for maximizing the play 215 by pressing on the armature 155 via the first spring 220. Due to the small absolute dimensions of the gap 235 and the play 215, these are barely visible in FIG. 7 and other figures.

Figure 8:
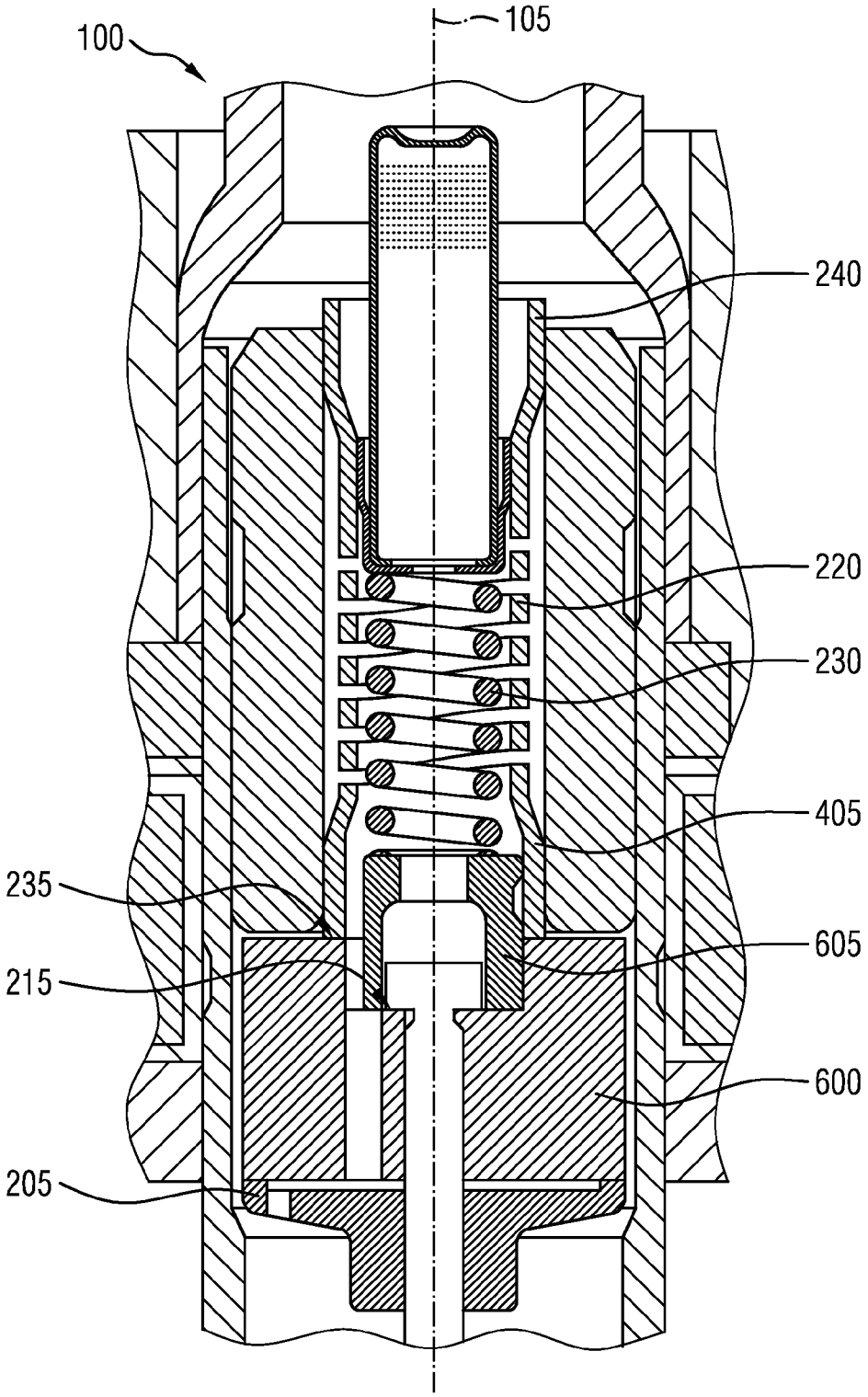

FIG. 8 shows one more exemplary embodiment of an injector 100. This embodiment is a variant of the embodiment described above in connection with FIG. 6.

In contrast to that embodiment, the second spring 225 is omitted in the present embodiment. Instead, the third spring 230 is seated on the insert 605 of the armature 155 instead of being seated against the needle 135. In this way, the third spring 230 has a triple function: It is operable to bias the armature 155 away from the pole piece 250, it is operable to bias the armature 155 away from the upper retainer 210 and at the same time it is operable to bias the needle 135 towards the closed position 145 by means of mechanical engagement via the armature 155 and the bushing 205.

Figure 9:
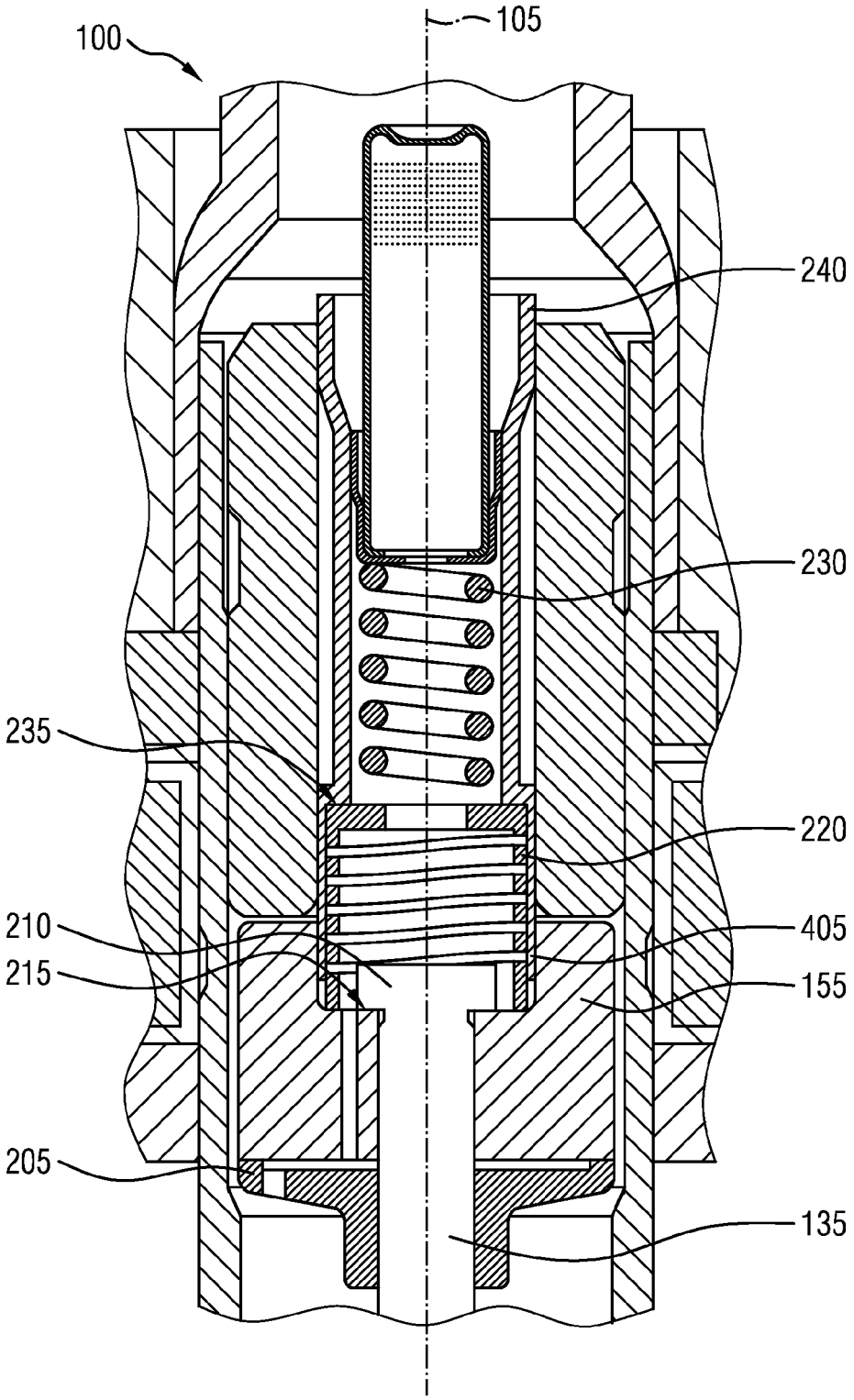

FIG. 9 shows yet one more exemplary embodiment of an injector 100. The present embodiment is based on the embodiment of FIG. 7. However, analogously to the previously described embodiment of FIG. 8, no second spring 225 is provided. Consequently, also the further step of the outer tube 405 is omitted.

The third spring 230 is seated on the end of the first spring 220 which is remote from the armature 155. In this way, the third spring 230 is operable to bias the first spring 220 away from the step of the outer tube 405, it is operable to bias the armature 155 away from the pole piece 250 and from the upper retainer 210 by means of mechanical interaction via the first spring 220, and at the same time it is operable to bias the needle 135 towards the closed position 145 by means of mechanical engagement via the first spring 220, the armature 155 and the bushing 205. Calibration of tension of the third spring 230 and gap size 235 can be done independently from each other.

What is claimed is:

1. A fuel injector for injecting fuel into a combustion engine, the fuel injector comprising: a valve with a needle that is movable along a longitudinal axis between an open position and a closed position, to open and close the valve; an actuator comprising an armature and a pole piece, wherein the armature is axially movable and operable to interact mechanically with the needle such that the needle is moved towards the open position by an axial movement of the armature towards the pole piece; a first spring for biasing the armature axially away from the pole piece, wherein a spring force of the first spring stops said movement of the armature when the needle is in the open position, the armature is axially displaceable relative to the needle, the needle has an upper retainer and the armature is operable to establish a form-fit engagement with the upper retainer for moving the needle towards the open position, the injector further comprises a second spring that biases the armature away from the upper retainer, and the second spring being softer than the first spring.

2. The fuel injector of claim 1, wherein the armature is spaced apart from the pole piece when the needle is in the open position.

3. The fuel injector of claim 1, wherein the first spring is axially movable relative to the pole piece and has an axial play towards the pole piece when the needle is in the closed position.

4. The fuel injector of claim 3, wherein in the open position of the needle, a deflection of the first spring is small compared to the axial play of the first spring.

5. The fuel injector of claim 1, wherein the first spring is axially displaceable relative to the needle and axially arranged between the second spring and the armature such that a spring force of the second spring is transferred to the armature via the first spring.

6. The fuel injector of claim 1 wherein the armature is spaced apart from the pole piece by a fuel filled axial gap, such that the gap is reduced when the needle is moved towards the open position, wherein the gap is shaped and dimensioned to provide a hydraulic dampening to the movement of the armature.

7. The fuel injector of claim 1, wherein the first spring comprises a hollow cylindrical body with a radial opening.

8. The fuel injector of claim 7, wherein the radial opening is a helical cut.

9. The fuel injector of claim 1, further comprising a third spring configured to move the needle towards the closed position.

10. The fuel injector of claim 1, wherein a spring seat for an end of a third spring remote from the needle is axially movable relative to a spring seat for an end of the first spring remote from the armature to calibrate a preload of the third spring.

11. The fuel injector of claim 10, wherein:

the spring seat for said end of the first spring is press-fitted into an opening of the pole piece, and the spring seat for said end of the third spring is press fitted into an opening of the spring seat for said end of the first spring.

12. The fuel injector of claim 10, wherein:

the armature is axially displaceable relative to the needle, the needle has an upper retainer, and the armature is operable to establish a form-fit engagement with the upper retainer for moving the needle towards the open position, the injector further comprises a second spring that biases the armature away from the upper retainer, the second spring being softer than the first spring, and the third spring is harder than the second spring but softer than the first spring.

13. The fuel injector of claim 1, wherein the needle is configured to open the valve when the needle is moved away from a nozzle end of the injector.

14. A combustion engine, comprising: a plurality of fuel injector configured to inject fuel into the engine, each fuel injector comprising: a valve with a needle that is movable along a longitudinal axis between an open position and a closed position, to open and close the valve; an actuator comprising an armature and a pole piece, wherein the armature is axially movable and operable to interact mechanically with the needle such that the needle is moved towards the open position by an axial movement of the armature towards the pole piece; a first spring for biasing the armature axially away from the pole piece, wherein a spring force of the first spring stops said movement of the armature when the needle is in the open position, for each fuel injector: the armature is axially displaceable relative to the needle, the needle has an upper retainer and the armature is operable to establish a form-fit engagement with the upper retainer for moving the needle towards the open position, the injector further comprises a second spring that biases the armature away from the upper retainer, and the second spring being softer than the first spring.

15. The combustion engine of claim 14, wherein, for each fuel injector, the armature is spaced apart from the pole piece when the needle is in the open position.

16. The combustion engine of claim 14, wherein, for each fuel injector, the first spring is axially movable relative to the pole piece and has an axial play towards the pole piece when the needle is in the closed position.

17. The combustion engine of claim 16, wherein, for each fuel injector, in the open position of the needle, a deflection of the first spring is small compared to the axial play of the first spring.

18. The combustion engine of claim 14, wherein, for each fuel injector, the first spring is axially displaceable relative to the needle and axially arranged between the second spring and the armature such that a spring force of the second spring is transferred to the armature via the first spring.

* * * * *